United States Patent [19]

Bertilsson

[11] Patent Number: 4,979,873

[45] Date of Patent: Dec. 25, 1990

[54] STEAM TURBINE

[75] Inventor: Jan-Erik Bertilsson, Siggenthal-Station, Switzerland

[73] Assignee: ASEA Brown Boveri Ltd., Baden, Switzerland

[21] Appl. No.: 302,373

[22] Filed: Jan. 27, 1989

[30] Foreign Application Priority Data

Feb. 1, 1988 [CH] Switzerland ..... 332/88

[51] Int. Cl.[5] ..... F01D 17/00

[52] U.S. Cl. ..... 415/144

[58] Field of Search ..... 415/144, 202, 181, 199.4, 415/199.5, 119; 60/646, 657

[56] References Cited

U.S. PATENT DOCUMENTS

| | | | |
|---|---|---|---|
| 1,090,110 | 3/1914 | Thomsen | 415/144 |
| 2,269,235 | 1/1942 | Warren | 415/144 |
| 2,952,973 | 9/1960 | Hall et al. | 415/144 |
| 4,393,658 | 7/1983 | Bohnekamp et al. | 415/144 |
| 4,527,387 | 7/1985 | Lastrina et al. | 415/121.2 |

FOREIGN PATENT DOCUMENTS

| | | | |
|---|---|---|---|
| 663207 | 7/1938 | Fed. Rep. of Germany . | |
| 831580 | 2/1952 | Fed. Rep. of Germany | 415/144 |
| 731766 | 9/1932 | France | 415/144 |
| 211167 | 11/1940 | Switzerland . | |
| 182737 | 8/1966 | U.S.S.R. . | |
| 530022 | 12/1940 | United Kingdom . | |

*Primary Examiner*—John T. Kwon

*Attorney, Agent, or Firm*—Burns, Doane, Swecker & Mathis

[57] ABSTRACT

A steam turbine suitable for part-load operation is disclosed as including a turbine duct having a first stage group of blades and a continuously open bypass duct having a fixed flow area. A nozzle group control mechanism imparts a swirling motion to a steamflow such that a first portion of the steamflow is urged through the continuously open bypass duct and a second portion of the steamflow is urged through the first stage group of blades.

7 Claims, 1 Drawing Sheet

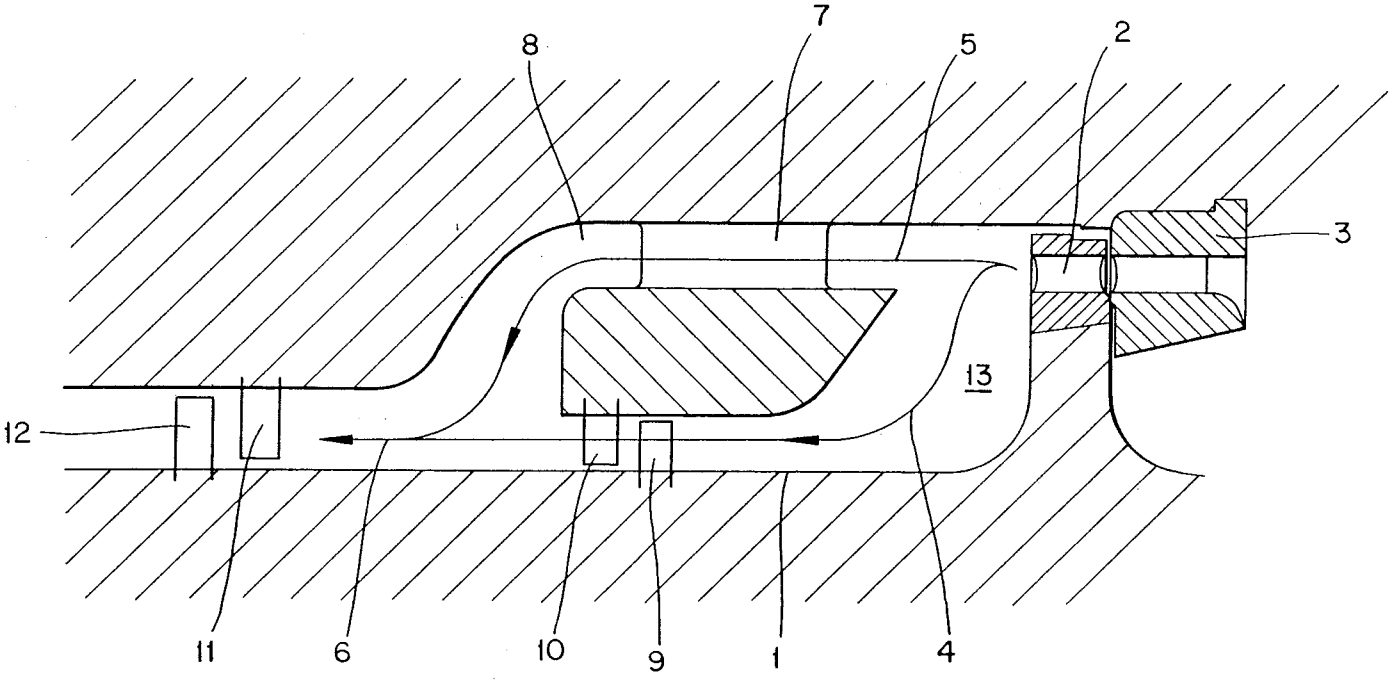
3
2
5
7
8
12
13
4
1
9
10
6
11

STEAM TURBINE

BACKGROUND OF THE INVENTION

1. Field of the Invention

The invention relates to a steam turbine which is operated in the part-load range with nozzle group control.

2. Discussion of Background

In steam turbine construction, control wheels having separately opening nozzle groups are used for power control because the efficiency which can be attained thereby is better, when considered over the significant power range, than in the case of other systems. The control wheel itself has the effect that work is drawn from the steam in such a way that power control in itself acts optimally.

In order to achieve full admission in the following stages, an equalization space is provided, which makes possible the transition from partial admission to full admission.

However, this is accomplished only incompletely, and therefore a nonuniform flow onto the reaction stages is produced. This flow inhomogeneity has the effect that the blades of the stages following the control wheel are subjected to harmful vibrations, which sometimes can lead to damage.

In order to avoid the nonuniform oncoming flow mentioned, various proposals have become known:

(a) Enlargement of the wheel space.

Whilst in the case of steam turbines of the smallest power class this is feasible within close limits, because so much space can be gained between the plane of discharge of the control wheel subjected to partial admission and the plane of entry of the first stage subjected to full admission that the flow downstream of the control wheel up to entry into the following part of the turbine can be made substantially uniform, in the case of steam turbines of greater power, which are characterized by large quantities of steam and large rotor diameters, it is constructionally not possible to design an intended control wheel much larger with respect to the following part subjected to full admission. Consequently, the space between the control wheel subjected to partial admission and the following part of the turbine subjected to full admission, for making the flow uniform over the entire circumference of the flow duct, remains small, as a result of which flow inhomogeneities are retained.

(b) Enlargement of the difference in diameter between control wheel and following parts of the turbine.

In fact, the argumentation presented under (a) applies here as well. By enlarging the diameter of the control wheel with respect to the diameter of the following stages, so much space is gained only in the case of steam turbines of the smaller power class between the plane of discharge of the control wheel subjected to partial admission and the plane of entry of the first stage subjected to full admission that the greatest flow inhomogeneities can be intercepted.

(c) Installation of restricting elements such as baffle or eddy space.

These precautions are, on the one hand, too complicated and, on the other hand, have adverse effects on the efficiency of the machine.

(d) Introduction of a swirl space downstream of the first reaction guide row.

This measure lengthens the machine unnecessarily, with all the constructional and economic disadvantages this entails.

SUMMARY OF THE INVENTION

Accordingly, one object of this invention, as defined in the claims, is to make the flow uniform at the transition from partial admission in the control stage to full admission of the remaining stages in the case of a steam turbine which is operated in the part-load range with nozzle group control.

The operating principle of the proposal involves the stream of steam being divided into two part-streams after the nozzle group. While a first part-stream is admitted to a first stage group, the other part-stream flows directly via a bypass duct to the second stage group, which then simultaneously also admits the first part-stream and is thus a stage group subjected to full admission, in contrast to the stage group subjected to the partial admission of the first part-stream alone.

The essential advantage of the invention is to be seen in that the first stage group subjected to partial admission indeed only admits a partial quantity, having the effect that the dynamic excitation of the blading is reduced to about 50%. Due to the fact that this stage group subjected to partial admission is given a lower blade height due to the reduced mass flows, higher natural blade frequencies can be expected, thereby significantly reducing the risk of excitation.

Advantageous and expedient further developments of the way of achieving the object according to the invention are defined in the dependent claims.

An exemplary embodiment of the invention is explained below with reference to the single figure.

All elements not necessary for a direct understanding of the invention have been omitted.

BRIEF DESCRIPTION OF THE FIGURE

A more complete appreciation of the invention and many of the attendant advantages thereof will be readily obtained as the same becomes better understood by reference to the following detailed description when considered in connection with the accompanying single FIGURE, wherein: the section between nozzle group control and the first rows of blades of the turbine is shown.

DESCRIPTION OF THE PREFERRED EMBODIMENT

In the FIGURE, a section of a steam turbine can be seen, to be precise it shows the region between control wheel 2/nozzle 3 and the first rows of blades 11, 12 of the turbine. In the case of the present control part, the diameter of the control wheel 2 is dimensioned to be greater than the diameter of the hub 1. In principle, the difference in diameter must be maintained such that, with a reasonable length, in terms of constructional effort, of the overflow duct between control stage and reaction stage of the duct volume is adequate for complete homogenization of the flow over the entire duct circumference. In the present case, it is in fact possible to dispense with this optimization since, from the outlet of the control wheel 2, the steam flow is divided into two part-streams 4, 5, in the sense that the part-stream 5 flows through a bypass duct 8, in order then to merge with the other part-stream 4 before admission to the stage group of the turbine 11, 12. This second part-stream 4 is admitted firstly to a first stage group 9, 10 of blades which has a lower blade height with respect to the other stage group 11, 12 provided downstream. In terms of flow dynamics, this is possible to the extent that admission to this first stage group 9, 10 is with a reduced mass flow. The advantages are eminent: the higher natural blade frequencies of this first stage group 9, 10 cause a significant reduction in the risk of excitation, as a result of which a homogeneous flow is admitted to the second downstream stage group 11, 12. Deflection elements 7, which cause a uniform distribution of the stream of steam over the entire circumference, are provided in the bypass duct 8.

The division of the stream of steam into two part-streams 4, 5, in which the stage group 9, 10 to which the part-stream 4 is first admitted preferably consists of two blade stages, has the effect that the dynamic excitation of the turbine blading is reduced to about 50%. The admixing of the part-flow 4 downstream of the first stage group 9, 10 with the other part-stream 5 flowing through the bypass duct 8 takes place in such a way that a single stream of steam 6 is virtually fully admitted to the following stage group 11, 12. This is achieved with the aid of the already used deflecting elements 7. A good admixture is acheived moreover by the bypass duct 8 being spirally shaped. The duct 13 to the hub 1 is designed such that, at the fourth valve point, i.e. when no partial admission is arranged, the stream of steam is for the greatest part first admitted to the first stage group 9, 10. A nonuniform oncoming flow with flow inhomogeneities is not to be feared in this operating mode, since in this case the stream of steam is not influenced by the nozzle group control. At the second valve point, the stream of steam is deflected upward in the direction of the bypass duct 8 by the swirl produced by the nozzle group control 2, 3, as a result of which the equalization striven for of the flow nonuniformities produced from the part-load is effected. A distribution of the part-stream in the sense of effecting a flow homogeneity of the stream of steam can be achieved by the installation of restricting elements (not shown).

Obviously, numerous modifications and variations of the present invention are possible in the light of the above teachings. It is therefore to be understood that, within the scope of the appended claims, the invention may be practiced otherwise than as specifically described herein.

What is claimed as new nad desired to be secured by Letters Patent of the United States is:

1. A steam turbine which is operated in part-load operation with nozzle group control, wherein the steam flow downstream of the control wheel of the nozzle group control means is divided into at least two part-streams, a first part-stream being admitted to a first stage group of blades, a second part-stream flowing through a continuously open bypass duct according to a swirling motion imparted to said steam flow by said nozzle group control means, the bypass duct having a fixed flow area, and the part-streams flowing together upstream of a second stage group of blades, which lie downstream of the first group.

2. The steam turbine as claimed in claim 1, wherein the continuously open bypass duct has deflecting elements.

3. The steam turbine as claimed in claim 1, wherein the first stage group has a smaller blade height with respect to the following stage group.

4. A steam turbine suitable for part-load operation comprising:

a turbine duct;

a first stage group of blades and a continuously open bypass duct positioned within said turbine duct, said bypass duct having a fixed flow area;

nozzle group control means positioned at an inlet of said turbine duct for imparting a swirling motion to a steam flow such that a first portion of said steam flow is urged through said continuously open bypass duct and a second portion of said steam flow is urged through said first stage group of blades; and a second stage group of blades for receiving both said first and second portion of said steam flow, said second stage group of blades positioned downstream of said first group of blades.

5. The steam turbine as set forth in claim 4, wherein said continuously open bypass duct includes deflecting elements.

6. The steam turbine as set forth in claim 4, wherein a blade height of each of said first stage group of blades is smaller than a blade height of each of said second group of blades.

7. A steam turbine suitable for part-load operation comprising:

a turbine duct;

a first stage group of blades and a continuously open bypass duct positioned within said turbine duct, said first stage group of blades having a first blade height, said bypass duct including deflecting elements and having a fixed flow area;

nozzle group control means positioned at an inlet of said turbine duct for imparting a swirling motion to a steam flow such that a first portion of said steam flow is urged through said continuously open bypass duct and a second portion of said steam flow is urged through said first stage group of blades; and a second stage group of blades for receiving both said first and second portion of said steam flow, wherein a blade height of each said first stage group of blades is smaller than a blade height of each of said second group of blades.

* * * * *